US005165670A

United States Patent [19]

Sawdon

[11] Patent Number: 5,165,670

[45] Date of Patent: Nov. 24, 1992

[54] RETRACTING POWER CLAMP

[75] Inventor: Edwin G. Sawdon, St. Clair, Mich.

[73] Assignee: BTM Corporation, Marysville, Mich.

[21] Appl. No.: 777,578

[22] Filed: Oct. 16, 1991

[51] Int. Cl.[5] ..... B23Q 3/03; B25B 1/04

[52] U.S. Cl. ..... 269/32

[58] Field of Search ..... 269/32, 27, 24, 285, 269/239, 228, 91, 93, 94

[56] References Cited

U.S. PATENT DOCUMENTS

| | | |
|---|---|---|
| 1,667,616 | 4/1928 | Wright et al. . |
| 1,736,171 | 11/1929 | Powell . |
| 2,381,999 | 8/1945 | Bonnafe . |
| 3,058,214 | 10/1962 | Mekler . |
| 3,273,878 | 9/1966 | Blatt . |
| 3,371,923 | 3/1968 | Blatt . |
| 3,545,050 | 12/1970 | Blatt et al. . |
| 3,618,931 | 11/1971 | Blatt . |
| 3,702,185 | 11/1972 | Blatt . |
| 4,240,620 | 12/1980 | Tunkers . |
| 4,396,183 | 8/1983 | Lymburner . |
| 4,445,676 | 5/1984 | Tunkers . |
| 4,494,739 | 1/1985 | Valentine . |
| 4,496,138 | 1/1985 | Blatt . |
| 4,591,138 | 5/1986 | Baills et al. . |
| 4,637,597 | 1/1987 | McPherson et al. ..... 269/32 |
| 4,905,973 | 3/1990 | Blatt . |

OTHER PUBLICATIONS

BTM Omni-Head Mini-Power Clamps "New Concept In Industrial Power Clamps Simplifies Off-Center Mounting" 4 pages.

BTM Thin Power Clamps-8 pages.

Dynamco "SL" Series Limit Valves (Bulletin 200)-5 pages.

*Primary Examiner*—Robert C. Watson

*Attorney, Agent, or Firm*—Harness, Dickey & Pierce

[57] ABSTRACT

A fluid-actuated clamping device is adapted for releasably clamping and holding an item in a desired position at a desired location, with the clamping mechanism or sub-assembly being capable of being completely retracted into the body of the clamping device before and after clamping engagement of the item. The preferred clamping device is economically and conveniently converted between horizontal and vertical clamping applications due to its great degree of interchangeability of components in both of such applications.

22 Claims, 4 Drawing Sheets

RETRACTING POWER CLAMP

BACKGROUND AND SUMMARY OF THE INVENTION

The invention relates generally to fluid-actuated clamping devices for releasably clamping an item in a predetermined position. More specifically, the present invention relates to such clamping devices adapted for horizontal or for vertical clamping engagement of such an item and having a clamping mechanism capable of being extended from, and retracted into, the body of the device.

Frequently, in a wide variety of applications, it is desired to forcibly clamp and hold an item in a predetermined position or location in order to perform a machining or fabrication operation thereon, for example. In such applications, the complexity of the shape or configuration of the item being clamped often presents difficulties in clamping the item, in providing access for a clamping member to engage the item, or in terms of portions of the clamping device interfering with other operations or functions prior or subsequent to the clamping operation. Thus, it has been found to be advantageous to provide clamping devices having clamping components or mechanisms that are capable of being extended either for horizontal or for vertical clamping engagement of the item and that can be retracted into the body of the device in order to clear the way for other operations or for moving the item to another location.

Accordingly, the present invention provides an improved, fluid-actuated retracting clamping device for releasably clamping an item in a predetermined position, with the clamping device including an elongated body having a fluid chamber therein, and with a movable armature disposed within the body of the clamping device and extending longitudinally in such fluid chamber. The fluid chamber includes a pair of fluid ports longitudinally spaced from one another in fluid communication with the fluid chamber, with a piston longitudinally fixed on the armature and sealingly disposed for slidable longitudinal movement within the fluid chamber, between the first fluid ports in order to selectively and forcibly extend and retract the armature longitudinally in response to respective greater and lesser fluid pressures in one of the fluid ports with respect to the other of the fluid ports.

A clamping sub-assembly attached to the armature is extendable from the body, and retractable into the body, and preferably includes a sleeve member, a clamping member, and linkage means interconnecting the sleeve member and the clamping member. The arrangement provides for pivotal movement of the clamping member relative to the sleeve member between a transversely-extending and generally longitudinally-aligned positions with respect to the armature. In various embodiments of the invention, the clamping members are capable of engaging the item to be clamped either horizontally or vertically, or in any other desired position.

Accordingly, the clamping device according to the present invention provides a very wide degree of flexibility in positioning the clamping device and the item to be clamped, in maneuvering the armature and clamping member, in accessing a desired clamping engagement location on an item, and in holding such item in a predetermined position with the clamping force being capable of being exerted in a wide variety of clamping directions. In addition, the articulating clamping member is preferably fully retractable into the body of the clamping device when the clamping function is not needed or desired. Furthermore, the clamping device of the present invention uses a toggle action to increase clamping force.

Additional objects, advantages, and features of the present invention will become apparent from the following description and the appended claims, taken in conjunction with the accompanying drawings.

DETAILED DESCRIPTION OF THE PREFERRED EMBODIMENTS

Figure 1A:
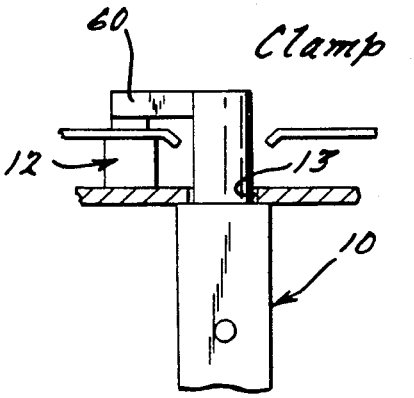
FIGS. 1A through 1C are diagrammatical representations of a clamping device according to the present invention employed for vertically clamping and holding an item in a predetermined position, shown in its "clamp", "release", and "retract" conditions.
Figure 2A:
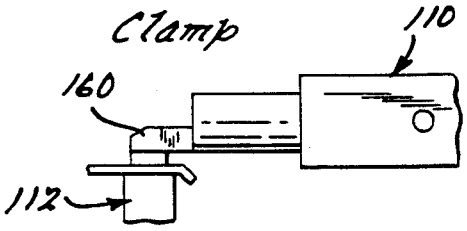
FIGS. 2A through 2C are diagrammatical representations similar to those of FIGS. 1A through 1C, but illustrating a clamping device according to the invention for horizontal clamping and holding an item in a predetermined position.

FIGS. 1 through 9 illustrate exemplary applications and embodiments of the present invention in clamping devices for releasably clamping an item in a predetermined desired position. One skilled in the art will readily recognize, however, that the principles of the present invention are not limited to the exemplary embodiments depicted in the drawings, as well as recognizing that the utility application of the present invention is not limited to the exemplary applications illustrated in the drawings.

Figure 1B:
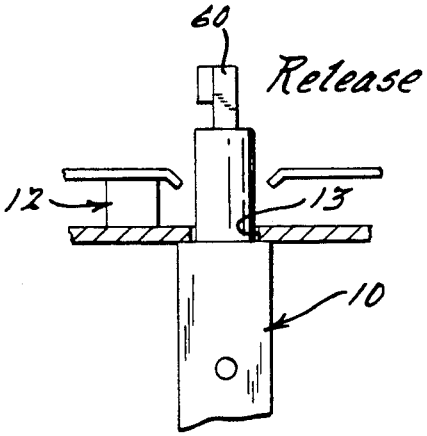
Figure 2B:
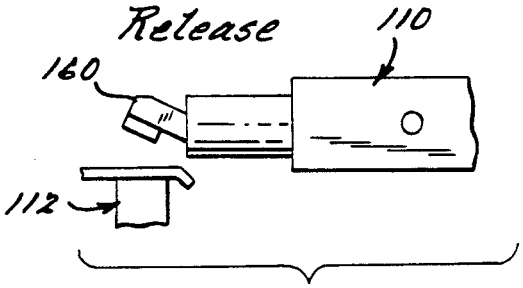
Figure 1C:
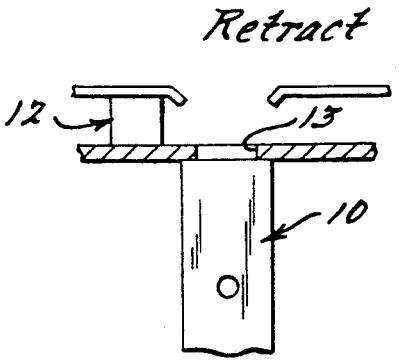
Figure 2C:
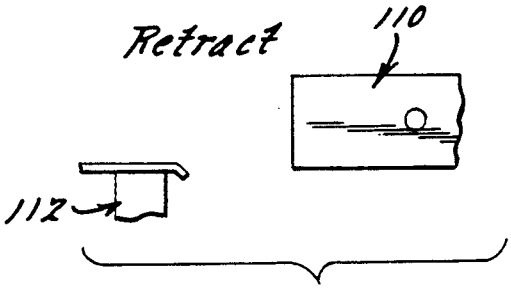

In FIG. 1A, a clamp device 10 is shown clampingly engaging and holding an exemplary item 12 in a predetermined position, with the item 12 having a relatively complex shape presenting a relatively complex access and clamping condition due to the fact that such access can only be gained through an opening 13 in the item 12. As will be explained in more detail below, however, the clamp device 10 according to the present invention is adapted to allow a clamping member 60 to be properly positioned with respect to the item 12 for extension and retraction through the opening 13 to allow access for vertically clamping the item 12 in the predetermined position, with the clamping force being exerted in a preselected location on the item 12. In FIGS. 1B and 1C, respectively, the clamping arm member 60 is released from the item 12 and then retracted through the opening 13 and into the clamping device 10.

Referring to FIGS. 3 through 6, the exemplary clamp device 10 according to the present invention includes a generally elongated body 14, with a fluid chamber 16 formed therein. One or more outer fluid ports 20 and at least one fluid port 22 provide fluid communication from an external source of pressurized fluid (not shown) to the interior of the fluid chamber 16, with the fluid ports 20 and 22 preferably being longitudinally spaced apart from one another at opposite ends of the fluid chamber 16. Such pressurized fluid can be any of a number of known actuating fluids, such as pressurized air in a pneumatic system, pressurized liquid hydraulic fluid in a hydraulic system, or other commonly used pressurized actuating fluids.

The clamp device 10 includes an elongated armature 26 disposed within the body 14 and extending longitudinally through at least part of the fluid chamber 16, with the body 14 having an inner longitudinal end sealingly closed off by inner the end cap 23 and an outer longitudinal end sealingly closed off by the outer end cap 25, through which the armature 26 sealingly extends and retracts a clamping mechanism or sub-assembly 30. As will be explained in more detail below, the armature 26 is capable of linear, longitudinal movement in either longitudinal direction, as indicated by the direction arrow 24 in FIGS. 3 through 5, for performing a desired clamping operation. Such linear longitudinal movement of the armature 26 is accomplished by the provision of a piston 28 disposed within the fluid chamber 16 and sealingly engaging interior wall portions thereof by way of a number of suitable piston seals 29. By way of the admission of greater or lesser respective fluid pressures in the respective longitudinally-spaced apart fluid ports 20 and 22, the piston 28 can be selectively and forcibly urged in either longitudinal direction along with the armature 26, which is longitudinally fixed to the piston 28. Articulating transverse clamping movement is provided in the clamp device 10 by way of the clamping mechanism or sub-assembly 30 interconnected with the armature 26 and movable between fully-retracted and fully-extended positions, as shown in FIGS. 3 through 5.

Figure 6:
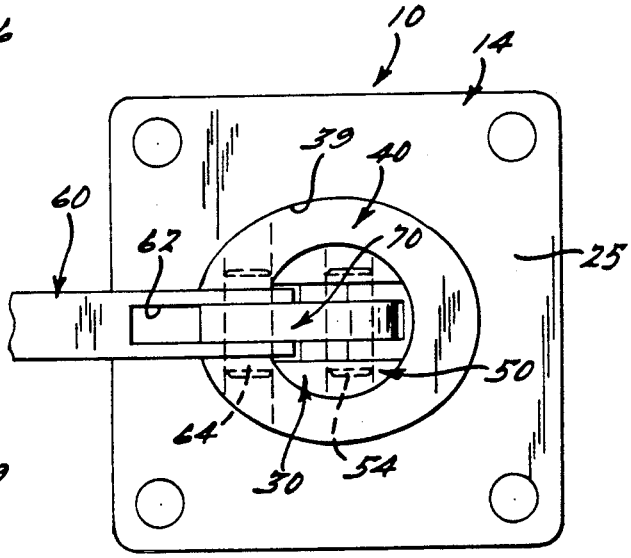
FIG. 6 is an outer end view of the clamping device of FIGS. 3 through 6.

The clamping mechanism or sub-assembly 30 generally includes a sleeve member 40 slidably disposed within the body 14, a slide member 50 interconnected with the armature 26, the above-mentioned clamping member 60, and a link member 70 pivotally interconnecting the slide member 50 and the clamping member 60, by way of pivot pins 54 and 64, respectively. Preferably, the sleeve member 40 is generally elliptical in cross-sectional shape in order to substantially prevent rotation of the sleeve member 40 in the complementary preferably elliptical outer opening 39, as illustrated in FIG. 6. The clamping member 60 is also pivotally interconnected with the sleeve member 40 by way of a pivot pin 66.

The sleeve member 40 includes a sleeve opening 41 through which the armature 26 is longitudinally extendable and retractable, with the armature 26 being sealingly engaged by a seal 42. The sleeve member 40 also includes a longitudinally inner cavity 43, having an open inner end oriented toward the piston 28, with the inner cavity 43 being adapted to receive a resilient biasing spring 48. The biasing spring 48 is preferably a relatively heavy compression spring having a high spring constant and abuttingly engages both the closed bottom portion of the inner cavity 43 of the sleeve member 40 and the piston 28. The resilient biasing spring 48 serves to resiliently bias the sleeve member 40 in a longitudinally outer direction away from the piston 28, as is explained in more detail below. The sleeve member 40 also includes a longitudinally outer cavity 44 adapted for receiving the above-mentioned slide member 50 slidably disposed therein for longitudinal extension and retraction. A sealing member 45 is provided in the outer end cap 25 for sealingly engaging the sleeve member 40 as it slidably extends and retracts.

Figure 3:
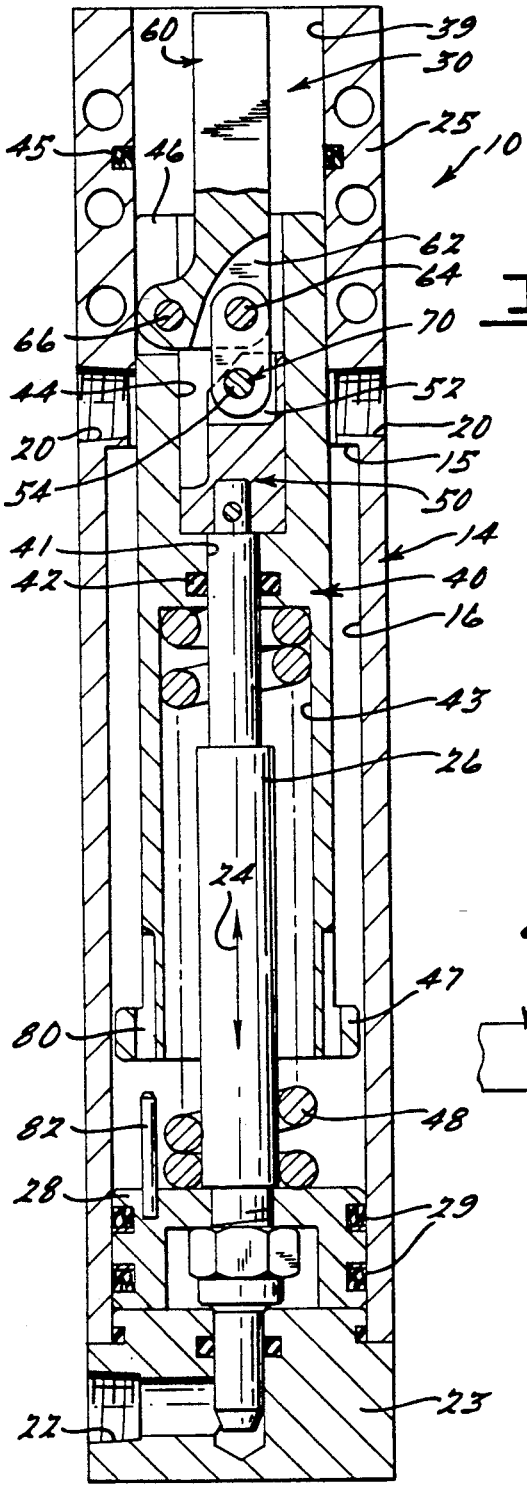
FIG. 3 is a longitudinal cross-sectional view of the clamping device of FIGS. 1A through 1C, shown in a fully-retracted condition.
Figures 4, 5:
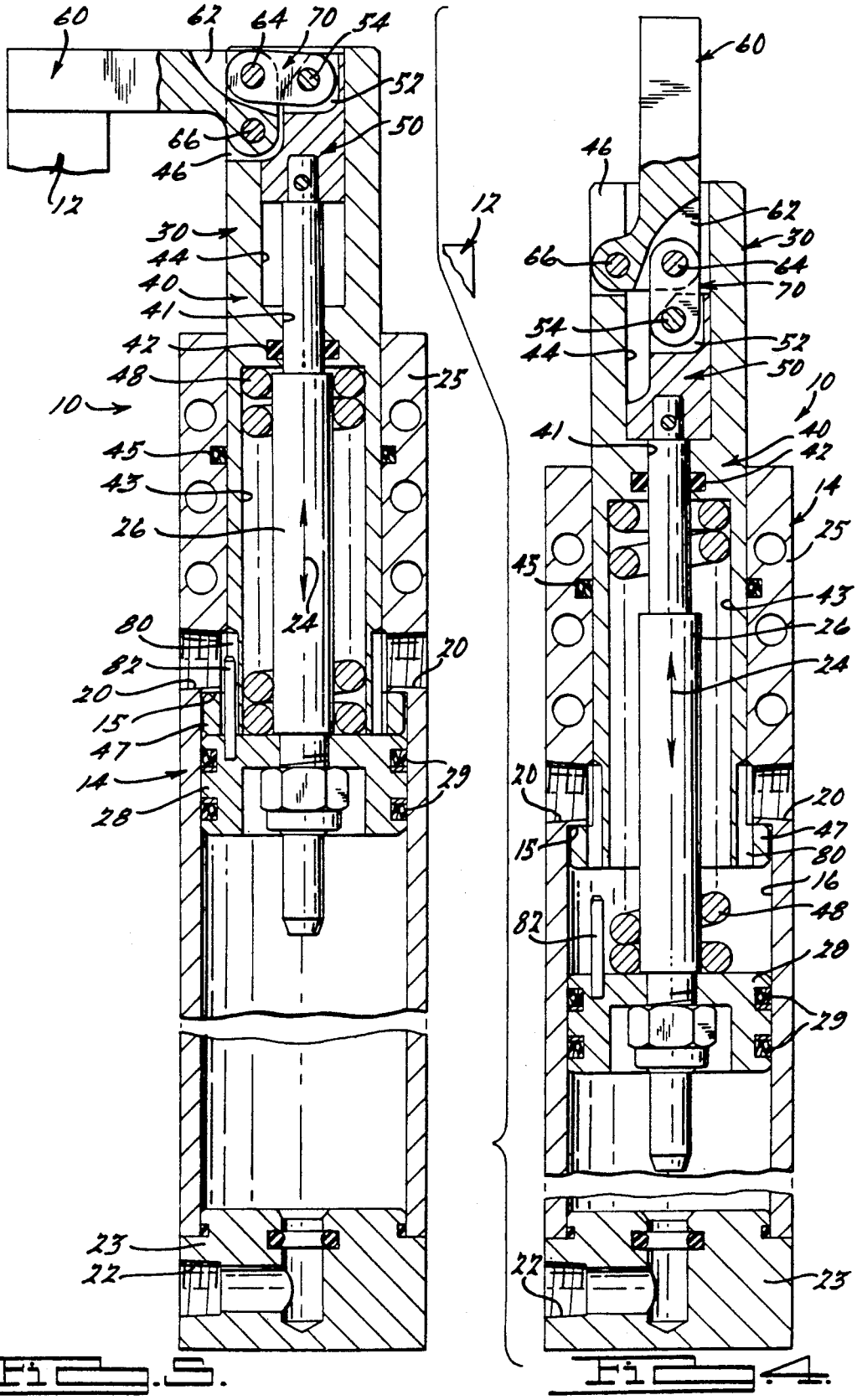
FIG. 4 is a longitudinal cross-sectional view similar to FIG. 3, but with the clamping device shown in a partially-extended, or partially-retracted, condition.
FIG. 5 is a longitudinal cross-sectional view similar to FIGS. 3 and 4, but with the clamping device shown in a fully-extended condition.

As is explained in more detail below, the clamping sub-assembly 30 is capable of articulating transverse movement, wherein the clamping member 60 is pivotally movable between a position generally longitudinally aligned with the armature 26, as shown in FIGS. 3 and 4, and a position extending transversely relative to the armature 26, as shown in FIG. 5. In order to accommodate such transverse pivoting movement of the clamping member 60, the sleeve member 40 includes a lateral cut-out or clearance opening 46 on one side thereof.

The slide member 50 includes a slot 52 formed in its longitudinally-outer end for receiving the link member 70 pivotally attached to the slide member 50 by way of the pivot pin 54. Similarly, the clamping member 60 includes a slot 62 formed therein for accommodating the relative pivotal movement of the link member 70, which is pivotally attached to the clamping member 60 by way of the pivot pin 64.

Preferably, the sleeve member 40 includes a recess 80 formed at its longitudinally-inner end for receiving a protrusion 82 fixed to the piston 28. The relative degree of extension of the protrusion 70 into or out of the recess 68, which can occur at or near both the fully-extended and fully-retracted conditions of the clamp device 10, can be used to monitor the operating conditions of the clamp device 10. Such monitoring of these conditions, along with the provision of an indication thereof, can be accomplished by conventional proximity sensing means and indicator means (not shown), which are well-known in the art for monitoring and indicating relative positions of two members.

The operation of the clamp device 10 is best explained with reference to FIGS. 3 through 5, illustrating the clamp device in its fully-retracted, partially-retracted or partially-extended, and fully-extended conditions, respectively. Upon the admission of pressurized actuating fluid through the fluid port 22 at a pressure greater than the pressure of the actuating fluid at the fluid ports 20, with the clamp device 10 in the condition shown in FIG. 3, the piston 28 is forcibly urged longitudinally outwardly in order to begin the movement toward the extended condition of the clamp device 10. With continued longitudinally outward movement of the piston 28 and the armature 26, the relatively stiff (high spring rate) resilient biasing spring 48 causes the sleeve member 40 to move longitudinally outwardly along with the piston 28 and the armature 26. Such longitudinally outward movement of the piston 28, the armature 26, and the sleeve member 40 continues until a flange portion 47 of the sleeve member 40 abuttingly engages an internal step 15 of the body 14, as illustrated in FIG. 4.

Prior to the abutting engagement of the flange portion 47 of the sleeve member 40 with the internal step 15 of the body 14, the slide member 50, however, the link member 70, and the clamping member 60 have also moved longitudinally outwardly along with the piston 28, the armature 26, and the sleeve member 40. However, at the point of the extension process illustrated in FIG. 4, continued longitudinally outward movement of the piston 28 and the armature 26 causes the biasing-spring 48 to compress and the slide member 50 to move longitudinally outwardly within the outer cavity 44 of the sleeve member 50. This in turn causes the clamping member 60 to pivot transversely about the pivot pin 66, which restrains the clamping member 60 longitudinally relative to the now-stationary sleeve member 40. Accordingly, due to the clearance provided by the lateral clearance opening 46 in the sleeve member 40, the clamping member 60 continues to pivot transversely relative to the armature 26 to clampingly engage the item 12, as illustrated in FIG. 5, with a high clamping force due to the toggle action of the mechanism that pivots the clamping arm member 60 to its clamping position. At this point in the fully-extended, vertically-clamping condition of the clamp device 10, the above-mentioned protrusion 82 on the piston 28 extends into the recess 80 formed in the sleeve member 40 in order to provide an indication of a fully-clamped condition. Also, the abutting engagement of the piston 28 with the flange 47 of the sleeve member 40 limits the longitudinal outward movement of the armature 26 and the piston 28.

In order to release the clamping force of the clamping member 60 on the item 12, the above-described extension operation is reversed, by way of the admission of actuating fluid through the fluid ports 20 at a pressure greater than the pressure at the fluid port 22, thus causing the piston 28 to be forcibly retracted longitudinally inwardly along with the armature 26. Such longitudinally inward movement of the armature 26 causes the slide member 50 to longitudinally retract, which in turn causes pivotal movement of the clamping member 60 (by way of the link member 70) back to the position wherein the clamping member 60 is generally aligned longitudinally with the armature 26, as shown in FIG. 4. In this regard, the pivot pin 64 is offset longitudinally outwardly with respect to the pivot pin 54 in order to prevent binding of the mechanism and to assist the retracting force of the actuating fluid at the fluid ports 20, thus tending to compensate for the decrease in available surface area on the longitudinally outer side of the piston 20 resulting from the presence of the armature rod 26.

Once the clamping sub-assembly 30 is in the condition illustrated in FIG. 4, the continued laterally inward movement of the piston 28 and the armature 26 allows the resilient biasing spring 48 to resiliently expand until the sleeve member 40 is no longer abuttingly held in a position wherein its flange portion 47 engages the internal step 15, thus allowing complete retraction of the piston 28, the armature 26, and the sleeve member 40 to the fully-retracted condition illustrated in FIG. 3, which is limited by the engagement of the piston 28 with the inner end cap 23.

In this regard, it should be noted that the clamp device 10 illustrated in FIGS. 1A through 1C, and in FIGS. 3 through 6, can alternately be employed for applying a clamping force in a generally longitudinally outward direction, as well as in the generally longitudinally inward direction illustrated in FIG. 5. In such an alternate application, the clamp device 10 would be positioned relative to the item to be clamped such that the clamping member 60 would clampingly engage the item to be clamped when the clamp device is in the condition illustrated in FIG. 4. In such an application, the above-mentioned transverse articulation of the clamping member 60 relative to the sleeve member 40 and the slide member 50 would not be necessary. Thus the embodiment of the invention exemplified by the clamp device 10 offers a great degree of flexibility in its applications to varied clamping situations.

Figure 7:
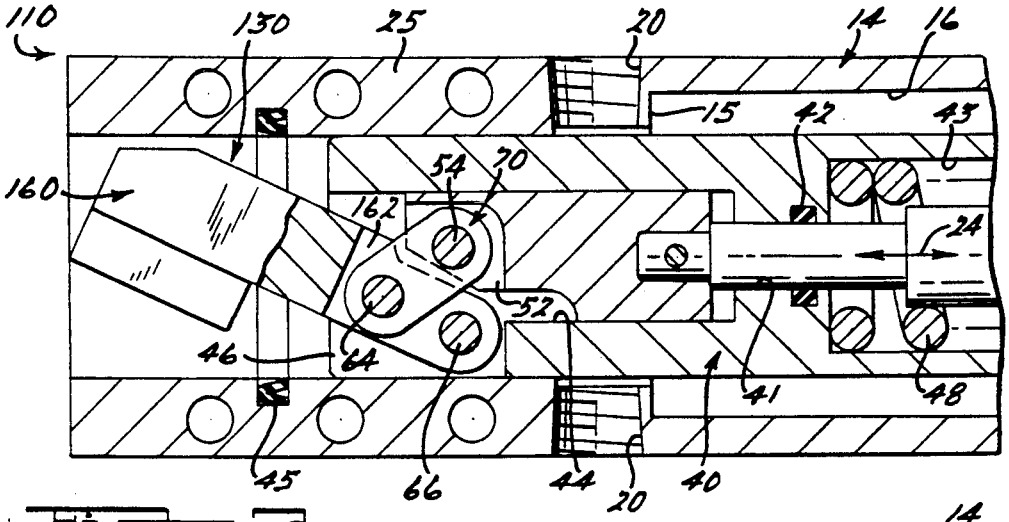
FIGS. 7 through 9 are partial longitudinal cross-sectional views similar to those of FIGS. 3 through 4, respectively, but illustrating the clamping device of FIGS. 2A through 2C.
Figure 8:
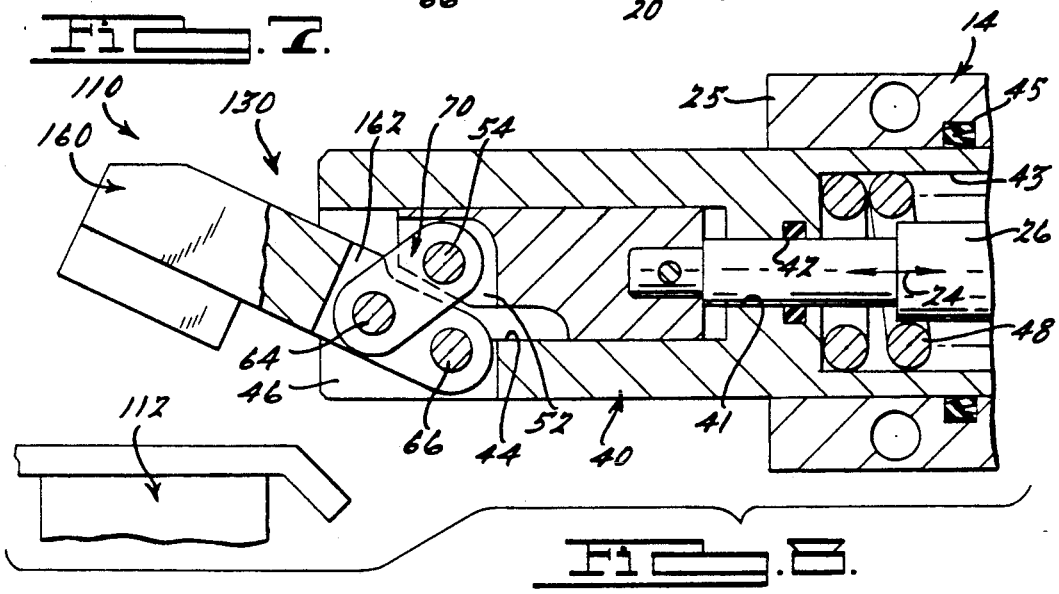
Figure 9:
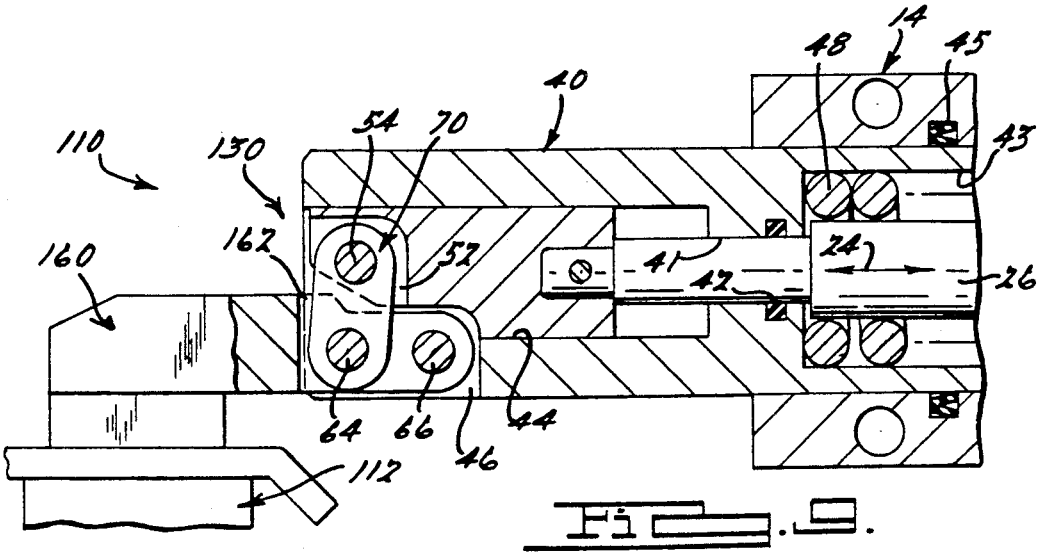

FIGS. 7 through 9 illustrate an alternate embodiment of the invention, wherein a clamp device 110 is substantially identical to the clamp device 10 described above, with the exceptions noted below. Such clamp device 110 is used in applications requiring horizontal clamping of an item, and thus provides the same wide degree of flexibility in horizontal clamping applications as is provided by the clamp device 10 in vertical clamping applications.

In order to provide for enhanced economy in manufacturing, installing, and servicing clamping devices according to the present invention, the clamp device 110 and the clamp device 10 described above are capable of complete interchangeability of nearly all components. Therefore, in order to accommodate the horizontal clamping movement required by the clamp device 110, the previously-described clamping member 60 of the clamp device 10 is merely replaced by the alternate clamping member 160 shown in FIGS. 7 through 9.

The function and operation of the clamp device 110 is substantially the same as that described above in connection with the clamp device 10 shown in FIGS. 3 through 5, except that the difference in physical configuration and location of the pivot pins 164 and 166 for the clamping member 160 result in the clamping member 160 being transversely pivotal between a clamping position wherein the clamping member 60 is generally longitudinally aligned with the armature 26, as shown in FIG. 9, and a release position extending transversely relative to the armature 26, as illustrated in FIG. 7. In all other respects, however, the clamp device 110 is virtually identical to the clamp device 10, thus affording the above-mentioned great degree of interchangeability of components, as well as economical and convenient conversion by the user of a clamping device according to the present invention between horizontal and vertical clamping applications merely by substituting the appropriate clamping members 160 or 60, respectively. In this regard it should be noted that the clamping arm member 160 is pivoted with the same type of force-increasing toggle action as is described above with respect to the clamping arm member 60.

The foregoing discussion discloses and describes merely exemplary embodiments of the present invention for purposes of illustration only. One skilled in the art will readily recognize from such discussion, and from the accompanying drawings and claims, that various changes, modifications, and variations can be made therein without departing from the spirit and scope of the invention as defined in the following claims.

What is claimed is:

1. A fluid-actuated, retractable clamping device for releasably clamping an item in a predetermined position, said clamping device comprising:

an elongated body having a fluid chamber therein and a pair of fluid ports longitudinally spaced from one another in fluid communication with said fluid chamber;

an armature disposed within said body and extending longitudinally in said fluid chamber;

a piston longitudinally fixed on said armature and sealingly disposed for slidable longitudinal movement within said fluid chamber between said fluid ports in order to selectively and forcibly extend and retract said armature longitudinally outwardly and inwardly, respectively, in response to respective greater and lesser fluid pressures in one of said fluid ports with respect to the other of said fluid ports; and a clamping sub-assembly interconnected with a longitudinally outer portion of said armature and being selectively and forcibly extendable and retractable therewith between fully-extended and fully-retracted positions in order to be movable into and out of said clamping engagement with the item in response to selective longitudinal movement of said armature, said clamping sub-assembly including a sleeve member, a clamping member, and linkage means interconnecting said sleeve member and said clamping member and providing for movement of said clamping member relative to said sleeve member to and from a transversely-extending position relative to said armature at least when said clamping sub-assembly is in an extended position protruding longitudinally from an outer end of said elongated body, said sleeve member having a longitudinally-extending sleeve opening therein, said armature extending longitudinally within said sleeve opening for slidable longitudinal movement relative thereto, said linkage means being interconnected with said armature and said clamping member, and said clamping member being pivotally interconnected with said sleeve member, said pivotal movement of said clamping member occuring in response to said extension and retraction of said armature over a predetermined outer range of its movement.

2. A fluid-actuated, retractable clamping device for releasably clamping an item in a predetermined position, said clamping device comprising:

an elongated body having a fluid chamber therein and a pair of fluid ports longitudinally spaced from one another in fluid communication with said fluid chamber;

an armature disposed within said body and extending longitudinally in said fluid chamber;

a piston longitudinally fixed on said armature and sealingly disposed for slidable longitudinal movement within said fluid chamber between said fluid ports in order to selectively and forcibly extend and retract said armature longitudinally outwardly and inwardly, respectively, in response to respective greater and lesser fluid pressures in one of said fluid ports with respect to the other of said fluid ports; and a clamping sub-assembly interconnected with a longitudinally outer portion of said armature and being selectively and forcibly extendable and retractable therewith between fully-extended and fully-retracted positions in order to be movable into and out of said clamping engagement with the item in response to selective longitudinal movement of said armature, said clamping sub-assembly including a sleeve member, a clamping member, and linkage means interconnecting said sleeve member and said clamping member and providing for pivotal movement of said clamping member relative to said sleeve member to and from a transversely-extending position relative to said armature at least when said clamping sub-assembly is in an extended position protruding longitudinally from an outer end of said elongated body, said sleeve member being disposed at least partially within said body and being longitudinally movable relative to said armature between longitudinally limited positions relative to said elongated body, said clamping assembly further including resilient biasing means for resiliently biasing said sleeve member in a longitudinal outward direction away from said piston, said pivotal movement of said clamping member occurring in response to said extension and retraction of said armature over a predetermined outer range of its movement.

3. A clamping device according to claim 2, wherein said sleeve member has a longitudinally-extending sleeve opening therein, said armature extending longitudinally within said sleeve opening for slidable longitudinal movement relative thereto, said linkage means being interconnected with said armature and said clamping member, and said clamping member being pivotally interconnected with said sleeve member.

4. A clamping device according to claim 3, wherein said clamping assembly further includes a slide member attached to said outer longitudinal end of said armature and a link member pivotally interconnected with both said slide member and said clamping member.

5. A clamping device according to claim 4, wherein said sleeve member has a longitudinally-extending outer cavity therein, said outer cavity communicating with said sleeve opening and having an open end at the longitudinally outer end of said sleeve member, said slide member being slidably disposed within said outer cavity, and said clamping member protruding from said open end of said outer cavity at least when said clamping sub-assembly is in said fully-extended position.

6. A clamping device according to claim 5, wherein said sleeve member has a lateral clearance opening in a lateral side thereof, said lateral clearance opening communicating laterally with said outer cavity and longitudinally with said open end of said outer cavity in order to provide clearance for said pivotal movement of said clamping member to and from said transversely-extending position.

7. A clamping device according to claim 1, wherein said clamping member is pivotal between said transversely-extending position and a position generally aligned longitudinally with said armature.

8. A clamping device according to claim 7, wherein said clamping member clampingly engages the item when said clamping member is in said transversely-extending position.

9. A clamping device according to claim 7, wherein said clamping member clampingly engages the item when said clamping member is in said position generally aligned with said armature.

10. A clamping device according to claim 1, further including longitudinal position indicator means for providing an indication of the longitudinal position of said armature relative to said body.

11. A clamping device according to claim 10, wherein said longitudinal position indicator means includes a longitudinally-extending protrusion on said piston and a longitudinally-extending recess in said body adjacent said fluid chamber, said protrusion on said piston being longitudinally receivable in said recess and movable therein with said piston.

12. A clamping device according to claim 1, further including longitudinal limiting means for limiting the range of longitudinal movement of said armature.

13. A clamping device according to claim 2, wherein said sleeve member has a longitudinally-extending inner cavity therein, said inner cavity having an open end oriented toward said position at the longitudinally inner end of said sleeve member, said resilient biasing means being disposed in said inner cavity and bearing against said piston for resiliently biasing said sleeve member longitudinally away from said piston, said resiliently biasing means being resiliently compressed in response to longitudinally outward extension movement of said armature within said predetermined outer range of armature movement.

14. A clamping device according to claim 13, wherein said clamping member is pivotal between said transversely-extending position on a position generally aligned longitudinally with said armature, said clamping member clampingly engaging the item when said clamping member is in said transversely-extending position.

15. A clamping device according to claim 13, wherein said clamping member is pivotal between said position generally aligned with said armature on a position generally aligned longitudinally with said armature, said clamping member clampingly engaging the item when said clamping member is in said position generally aligned with said armature.

16. A fluid-actuated, retractable clamping device for releasably clamping an item in a predetermined position, said clamping device comprising:

an elongated body having a fluid chamber therein and a pair of fluid ports longitudinally spaced from one another in fluid communication with said fluid chamber;

an armature disposed within said body and extending longitudinally in said fluid chamber;

a piston longitudinally fixed on said armature and sealingly disposed for slidable longitudinal movement within said fluid chamber between said fluid ports in order to selectively and forcibly extend and retract said armature longitudinally outwardly and inwardly, respectively, in response to respective greater and lesser fluid pressures in one of said fluid ports with respect to the other of said fluid ports;

a clamping sub-assembly interconnected with a longitudinally outer portion of said armature and being selectively and forcibly extendable and retractable therewith between respective fully-extended and fully-retracted positions in order to be movable into and out of said clamping engagement with the item in response to selective longitudinal movement of said armature, said clamping sub-assembly including a sleeve member, a slide member, a clamping member, and a link member;

said sleeve member being disposed at least partially within said body, said sleeve member being longitudinally movable with said armature relative to said body during a longitudinally inner portion of the longitudinal range of movement of said armature and being longitudinally relative to said body during a longitudinally outer portion of the longitudinal range of movement of said armature, said clamping device further including resilient biasing means for resiliently biasing said sleeve member longitudinally outwardly away from said armature, said resilient biasing means being resiliently compressed during said longitudinally outer portion of the longitudinal range of movement of said armature;

said slide member being longitudinally fixed relative to said armature and longitudinally movable therewith, said slide member being longitudinally movable relative to said sleeve member during said longitudinally outer portion of the longitudinal movement of said armature;

said clamping member being pivotally interconnected with said sleeve member for pivotal movement during said longitudinally outer portion of said longitudinal movement of said armature, said clamping member being pivotal between a transversely-extending position relative to said armature and a generally longitudinally-aligned position relative to said armature; and said link member pivotally interconnecting said armature and said clamping member in order to cause said pivotal movement of said clamping member during said longitudinally outer portion of said longitudinal movement of said armature, said clamping member being urged into clamping engagement with the item when said clamping member is in said transversely-extending position.

17. A clamping device according to claim 16, wherein said sleeve member has a longitudinally-extending outer cavity having a longitudinally outer open end, said slide member being slidably disposed within said outer cavity, said clamping member protruding from said outer open end of said outer cavity at least when said clamping sub-assembly is in said fully-extended position.

18. A clamping device according to claim 17, wherein said sleeve member has a lateral clearance opening in a lateral side thereof, said lateral clearance opening communicating laterally with said outer cavity and longitudinally with said open end of said outer cavity in order to provide clearance for said pivotal movement of said clamping member to and from said transversely-extending position.

19. A clamping device according to claim 18, wherein said sleeve member has a longitudinally-extending inner cavity having a longitudinally open inner end oriented toward said piston, said resilient biasing means being disposed in said inner cavity and bearing against said piston for resiliently biasing said sleeve member longitudinally away from said piston.

20. A fluid-actuated, retractable clamping device for releasably clamping an item in a predetermined position, said clamping device comprising:

an elongated body having a fluid chamber therein and a pair of fluid ports longitudinally spaced from one another in fluid communication with said fluid chamber;

an armature disposed within said body and extending longitudinally in said fluid chamber;

a piston longitudinally fixed on said armature and sealingly disposed for slidable longitudinal movement within said fluid chamber between said fluid ports in order to selectively and forcibly extend and retract said armature longitudinally outwardly and inwardly, respectively, in response to respective greater and lesser fluid pressures in one of said fluid ports with respect to the other of said fluid ports;

a clamping sub-assembly interconnected with a longitudinally outer portion of said armature and being selectively and forcibly extendable and retractable therewith between respective fully-extended and fully-retracted positions in order to be movable into and out of said clamping engagement with the item in response to selective longitudinal movement of said armature, said clamping sub-assembly including a sleeve member, a slide member, a clamping member, and a link member;

said sleeve member being disposed at least partially within said body, said sleeve member being longitudinally movable with said armature relative to said body during a longitudinally inner portion of the longitudinal range of movement of said armature and being longitudinally relative to said body during a longitudinally outer portion of the longitudinal range of movement of said armature, said clamping device further including resilient biasing means for resiliently biasing said sleeve member longitudinally outwardly away from said armature, said resilient biasing means being resiliently compressed during said longitudinally outer portion of the longitudinal range of movement of said armature;

said slide member being longitudinally fixed relative to said armature and longitudinally movable therewith, said slide member being longitudinally movable relative to said sleeve member during said longitudinally outer portion of the longitudinal movement of said armature;

said clamping member being pivotally interconnected with said sleeve member for pivotal movement during said longitudinally outer portion of said longitudinal movement of said armature, said clamping member being pivotal between a transversely-extending position relative to said armature and a generally longitudinally-aligned position relative to said armature; and said link member pivotally interconnecting said armature and said clamping member in order to cause said pivotal movement of said clamping member during said longitudinally outer portion of said longitudinal movement of said armature, said clamping member being urged into clamping engagement with the item when said clamping member is in said longitudinally-aligned position.

21. A clamping device according to claim 20, wherein said sleeve member has a longitudinally-extending outer cavity having a longitudinally outer open end, said slide member being slidably disposed within said outer cavity, said clamping member protruding from said outer open end of said outer cavity at least when said clamping sub-assembly is in said fully-extended position.

22. A clamping device according to claim 21, wherein said sleeve member has a longitudinally-extending inner cavity having a longitudinally open inner end oriented toward said piston, said resilient biasing means being disposed in said inner cavity and bearing against said piston for resiliently biasing said sleeve member longitudinally away from said piston.

* * * * *